US008608281B2

(12) United States Patent
Ito

(10) Patent No.: US 8,608,281 B2
(45) Date of Patent: Dec. 17, 2013

(54) PAPER PRINTING METHOD FOR A LINE PRINTER, AND A LINE PRINTER

(75) Inventor: Kiyoshi Ito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/418,009

(22) Filed: Mar. 12, 2012

(65) Prior Publication Data

US 2012/0236075 A1 Sep. 20, 2012

(30) Foreign Application Priority Data

Mar. 16, 2011 (JP) ..... 2011-057679

(51) Int. Cl.
*B41J 23/00* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 6,390,584 | B1 * | 5/2002 | Larson et al. | 347/16 |
| 2006/0170729 | A1 * | 8/2006 | Sloan et al. | 347/37 |
| 2009/0085971 | A1 * | 4/2009 | Sakano | 347/37 |
| 2010/0245418 | A1 | 9/2010 | Shimizu et al. | |

FOREIGN PATENT DOCUMENTS

| | | | |
|---|---|---|---|
| JP | 08-192546 | A | 7/1996 |
| JP | 2005-014445 | A | 1/2005 |
| JP | 2010234735 | A | 10/2010 |

* cited by examiner

*Primary Examiner* — Matthew Luu
*Assistant Examiner* — Alexander D Shenderov
(74) *Attorney, Agent, or Firm* — Lowe Hauptman & Ham, LLP

(57) ABSTRACT

A paper printing method for a line printer that can print a next print job with a specific margin without reversing paper. To print on label paper using a head unit having a plurality of line printheads disposed at a specific interval along the conveyance direction of the label paper, a printhead moving step advances a head unit at a first position after printing ends to a second position, and a printing step prints a label while moving the head unit in the reverse of the conveyance direction. At the second position, the printing position of the last line inkjet head of the head unit is on the forward side of the start printing position of a label on the label paper.

16 Claims, 6 Drawing Sheets

PAPER PRINTING METHOD FOR A LINE PRINTER, AND A LINE PRINTER

Priority is claimed under 35 U.S.C. §119 to Japanese Application No. 2011-057679 filed on Mar. 16, 2011, which is hereby incorporated by reference in its entirety.

BACKGROUND

1. Technical Field

The present invention relates to a method of printing continuous paper using a line printer that prints to continuous paper using a head unit having a plurality of line printheads disposed with a specific gap therebetween in the paper conveyance direction, and to a line printer that prints to paper using this method.

2. Related Art

Line printers having inkjet line heads that are disposed at a specific interval along the conveyance direction of the continuous paper and eject different colors of ink are one type of printer used for color printing on continuous paper. Japanese Unexamined Patent Appl. Pub. JP-A-2010-234735 describes an ink ejection device that has an inkjet line head.

This type of line printer can perform the printing operation while continuously conveying continuous paper in the conveyance direction during continuous printing, an operation that continuously prints the same content. However, when printing a single print job of a specific length (such as one page) in response to a request from a host computer, an operation that reverses the continuous paper before printing starts to set the position on the continuous paper where printing starts to the printing position of the last of the plural inkjet line heads in the conveyance direction is required. This continuous paper reversing operation is described in FIG. 10 of JP-A-2010-234735.

FIG. 6 describes the need for this continuous paper reversing operation in a line printer having a plurality of inkjet line heads. For ease of understanding, this figure uses label paper having labels of a specific length affixed with a specific gap therebetween to a continuous liner. When a head unit 100 with inkjet line heads for ejecting cyan C, magenta M, yellow Y, and black K ink are used as shown in the figure, and printing one label 102 on the label paper 101 is finished, the trailing end of the label 102 that was printed is at the printing position 104*a* of the inkjet line head 104 for cyan C at the leading (downstream) end in the conveyance direction 103.

At this time the leading end 108*a* of the label 108 to be printed next has already passed the printing positions 105*a* to 107*a* of the inkjet line heads 105, 106, 107 on the upstream side of the cyan head 104. The label paper 101 must therefore be reversed before printing the next label so that the leading end 108*a* of the next label is returned to the printing position 107*a* of the inkjet line head 107 at the trailing (upstream) end of the conveyance direction 103. More specifically, if the distance from the printing position 104*a* at the downstream end to the printing position 107*a* at the upstream end is A, and the label gap is B, the label paper 101 must be reversed distance E (=A=B). If the label paper 101 is not reversed, every following label will have an undesirably large top margin.

However, unlike when cut sheet media is reversed, slack equal to the distance reversed will be created when the continuous paper is reversed, and the paper feed path must be configured so that this slack will not create a paper jam. In addition, because continuous paper is typically stored as roll paper wound into a roll, the paper feed load varies greatly due to slack and the inertia of the paper roll, for example, when the paper is then conveyed forward for printing after being reversed. As a result, a precision paper feed mechanism that can convey the paper with good precision without being affected by such load fluctuations is required. Such a paper feed path and paper feed mechanism increase the size and cost of the line printer, and are therefore undesirable.

SUMMARY

A paper printing method for a line printer according to the invention enables starting the printing operation for the next print job with a specific top margin without reversing the paper after printing one job is completed. A line printer according to the invention prints on paper using this paper printing method.

One aspect of the invention is a paper printing method for a line printer that prints on paper using a head unit having a plurality of line printheads disposed at a specific interval along the conveyance direction of the paper, including: a printhead moving step that advances the head unit in the conveyance direction from a predetermined first position on the paper conveyance path to a second position; and a printing step that prints a print job on the paper while moving the head unit in the reverse of the conveyance direction relative to the paper; wherein at the second position, the printing position of the line printhead that is the last of the line printheads of the head unit in the conveyance direction is positioned to the start printing position of one job on the paper or forward of the start printing position.

Instead of reversing the paper when starting a print job, the invention advances the head unit from a first position to the start printing position for one job or to a position slightly before. Problems resulting from reversing the paper can therefore be avoided, and the top margin can be controlled as desired.

The line printer according to the invention can be achieved by an operation that prints one print job by printing while conveying the paper and then printing while moving the head unit. Printing while first conveying the paper can be done as follows.

In this aspect of the invention the distance from the printing position of the first line printhead located at the front of the line printheads in the head unit in the conveyance direction to the printing position of the last line printhead located at the end in the conveyance direction is distance A, and the printhead moving step positions the head unit from the first position to the second position located distance A forward in the conveyance direction. The printing step prints on the paper while conveying the paper in the conveyance direction relative to the head unit stopped at the second position. When the end-of-printing position of one job on the paper reaches the printing position of the last line printhead of the head unit, conveyance of the paper stops. Next, printing to the paper continues while reversing the head unit from the second position to the first position, and head unit movement and printing stop when the head unit reaches the first position.

Printing while first moving the head unit can be done as follows. First, the printhead moving step positions the head unit distance A forward in the conveyance direction from the first position to the second position located. Next, the printing step prints on the paper while reversing the head unit from the second position to the first position, and stops moving the head unit when the head unit reaches the first position. Next, printing on the paper continues while moving the paper in the conveyance direction, and conveying the paper and printing stops when the end-of-printing position of one job on the paper reaches the printing position of the last line printhead of the head unit.

Further preferably, information that requires high reliability printing is preferably printed by the first line printhead located at the front of the line printheads in the head unit in the conveyance direction.

Printing information that requires high reliability printing is preferably completed in the printing step by the step that prints to the paper while reversing the head unit, or the step that prints to the paper while moving the paper in the conveyance direction relative to the stationary head unit.

A line printer according to another aspect of the invention can print one job using only an operation that prints while moving the head unit. In this case, the distance from the printing position of the first line printhead located at the front of the line printheads in the head unit in the conveyance direction to the printing position of the last line printhead located at the end in the conveyance direction is distance A, and the length in the conveyance direction from the start printing position to the end-of-printing position of one job in the printing step is D. The printhead moving step positions the head unit to the second position distance A+D forward from the first position, conveys the paper in the conveyance direction, and positions the start printing position of one job to the printing position of the last line printhead of the head unit at the second position. The next printing step prints on the paper while moving the head unit from the second position in reverse to the first position, and stops moving the head unit and printing when the head unit returns to the first position.

The second position of the head unit changes according to the printed length of one job in this method. Because the printed length is the same when printing to labels on label paper having labels of a constant length affixed at a constant interval to a liner, the second position of the head unit is always the same. This method is therefore suited to printing labels.

When the line printheads of the head unit are inkjet heads, the line printer has a maintenance unit that caps the nozzle surface of the inkjet head and performs a recovery operation called flushing that regularly ejects ink droplets from the nozzles in the printing standby state. In this case, the head unit can preferably move bidirectionally on a movement path from the maintenance unit past the first position to the second position, or a movement path from the maintenance unit past the second position to the first position.

This configuration can use the mechanism that moves the head unit to the maintenance unit as the mechanism that moves the head unit to the first position and the second position. The printing method of the invention can therefore be achieved without increasing device size or cost.

The method of the invention can also be used in color line printers. In this case the head unit of the line printer has a plurality of line printheads that eject different colors of ink.

The method of the invention can also be used when the paper is label paper having labels of a specific length affixed at a specific interval along the length of the surface of a liner.

Another aspect of the invention is a line printer that prints on paper using a head unit having a plurality of line printheads disposed at a specific interval along the conveyance direction of the paper, including: a control unit that advances the head unit in the conveyance direction from a predetermined first position on the paper conveyance path to a second position, and prints a print job on the paper while moving the head unit in the reverse of the conveyance direction relative to the paper; wherein at the second position, the printing position of the line printhead that is the last of the line printheads of the head unit in the conveyance direction is positioned to the start printing position of one job on the paper or forward of the start printing position.

EFFECT OF THE INVENTION

A paper printing method for a line printer and a line printer according to the invention do not need to reverse the paper when starting to print the next job after finishing printing one job. Because there is therefore no need to consider the effect of paper slack created by reversing the paper, the structure of the paper conveyance path and the paper conveyance mechanism can therefore be simplified compared with the related art, and the line printer can be made smaller and more compact at a lower cost.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the paper printing method for a line printer according to the present invention are described below with reference to the accompanying figures.

Figure 1:
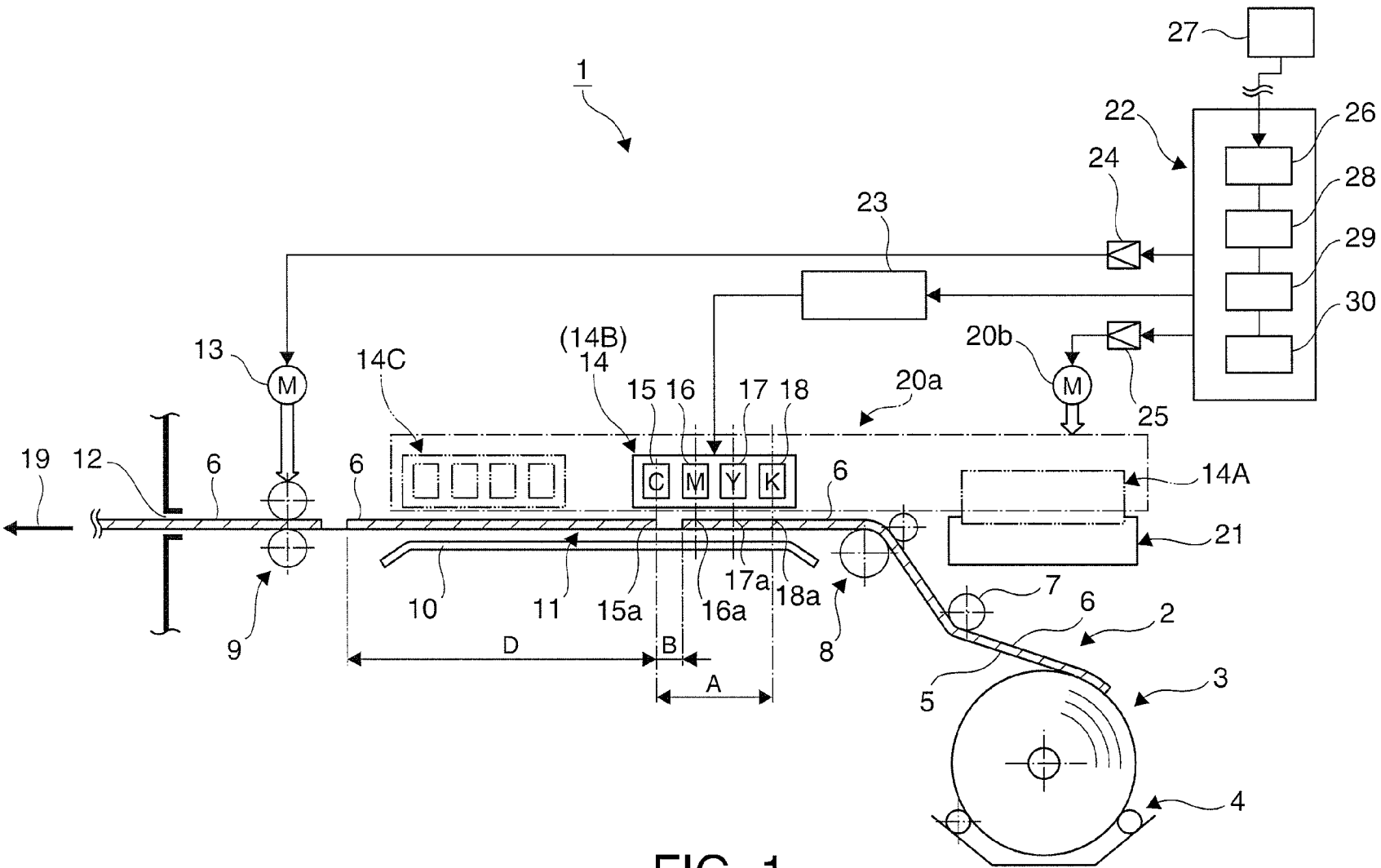
FIG. 1 shows the configuration of a line printer according to the invention.

FIG. 1 schematically describes the configuration of a line printer in which the invention can be used. The line printer in this figure has a plurality of inkjet line heads that eject different colors of ink. The following embodiments are described as printing to labels on label paper used as an example of continuous paper, but the invention is not so limited and can also be used to print on continuous paper other than label paper.

The line printer 1 has a roll paper compartment 4 for storing roll paper 3 having label paper 2 wound into a roll. The label paper 2 is pulled from the roll paper 3 stored in the roll paper compartment 4. The label paper 2 is continuous paper having labels 6 of a specific length D affixed at a constant interval B on the surface of a continuous liner 5 of a specific width.

The label paper 2 is conveyed to a paper exit 12 through a conveyance path to which a guide roller 7, follower-side paper feed roller pair 8, drive-side paper feed roller pair 9, and platen 10 are disposed. A paper feed mechanism for conveying the label paper 2 through the conveyance path includes the drive-side paper feed roller pair 9, follower-side paper feed roller pair 8, and a paper feed motor 13 for rotationally driving the drive-side paper feed roller pair 9. The follower-side paper feed roller pair 8 is connected through a gear train or other torque transfer mechanism not shown to the drive-side paper feed roller pair 9, and rotate synchronously with the drive-side paper feed roller pair 9. If roller pair 8 is used as the drive side, roller pair 9 can follow or be omitted.

A head unit 14 is disposed on one side, and the platen 10 that determines the printing position of the head unit 14 is disposed on the other side, of the straight conveyance path portion 11 between the drive-side paper feed roller pair 9 and the follower-side paper feed roller pair 8 on the conveyance path. The head unit 14 includes a set of four inkjet line heads 15, 16, 17, 18 disposed at a specific interval along the conveyance direction 19 of the label paper 2 denoted by the arrow.

The inkjet line head 15 at the front (downstream end) in the conveyance direction 19 ejects cyan ink C; the following inkjet line head 16 ejects magenta ink M; the following inkjet line head 17 ejects yellow ink Y; and the last inkjet line head 18 ejects black ink K. The distance from the printing position 15*a* of the first inkjet line head 15 and the printing position 18*a* of the last inkjet line head 18 is distance A. The gap between the printing positions (nozzle array positions) 15*a* to 18*a* of the adjacent inkjet line heads 15 to 18 is preferably uniform.

This head unit 14 can move reciprocally through a specific range in the conveyance direction 19 by means of a printhead moving mechanism. The printhead moving mechanism includes a linear motion guide mechanism 20*a* such as a ball screw and ball spline, and a linear motion motor 20*b*. A maintenance unit 21 is disposed at a position at the opposite end of the conveyance direction 19 as the drive-side paper feed roller pair 9, and the head unit 14 can move on a linear path bidirectionally from the maintenance position 14A denoted by the imaginary line opposite the maintenance unit 21, through a first position 14B denoted by a solid line toward the front in the conveyance direction 19, to a second position 14C denoted by an imaginary line at the front.

The control unit 22 of the line printer 1 controls driving other parts of the line printer 1, and more specifically controls the printing operation of the head unit 14 through a head driver 23, controls the paper feed operation of the paper feed motor 13 through a motor driver 24, and controls moving the head by means of the linear motion motor 20*b* through a motor driver 25.

The control unit 22 is communicatively connected to a host device such as a host computer 27 through a communication unit 26, and receives label print commands, for example, from the host computer 27. When a label print command is received through the communication unit 26, the control unit 22 temporarily stores the command in a receive buffer 28, and converts and writes the print data to color print data for each line printed by the different inkjet line heads 15 to 18 to a print buffer 30 by means of a data conversion unit 29. The inkjet line heads 15 to 18 are driven for each color through the head driver 23 based on the converted print data for each line, and a label is printed. Movement of the head unit 14 and conveyance of the label paper 2 are controlled by the control unit 22 as described below synchronized to the printing operation of the head unit 14 during label printing.

First Embodiment of a Label Printing Operation

Figure 2:
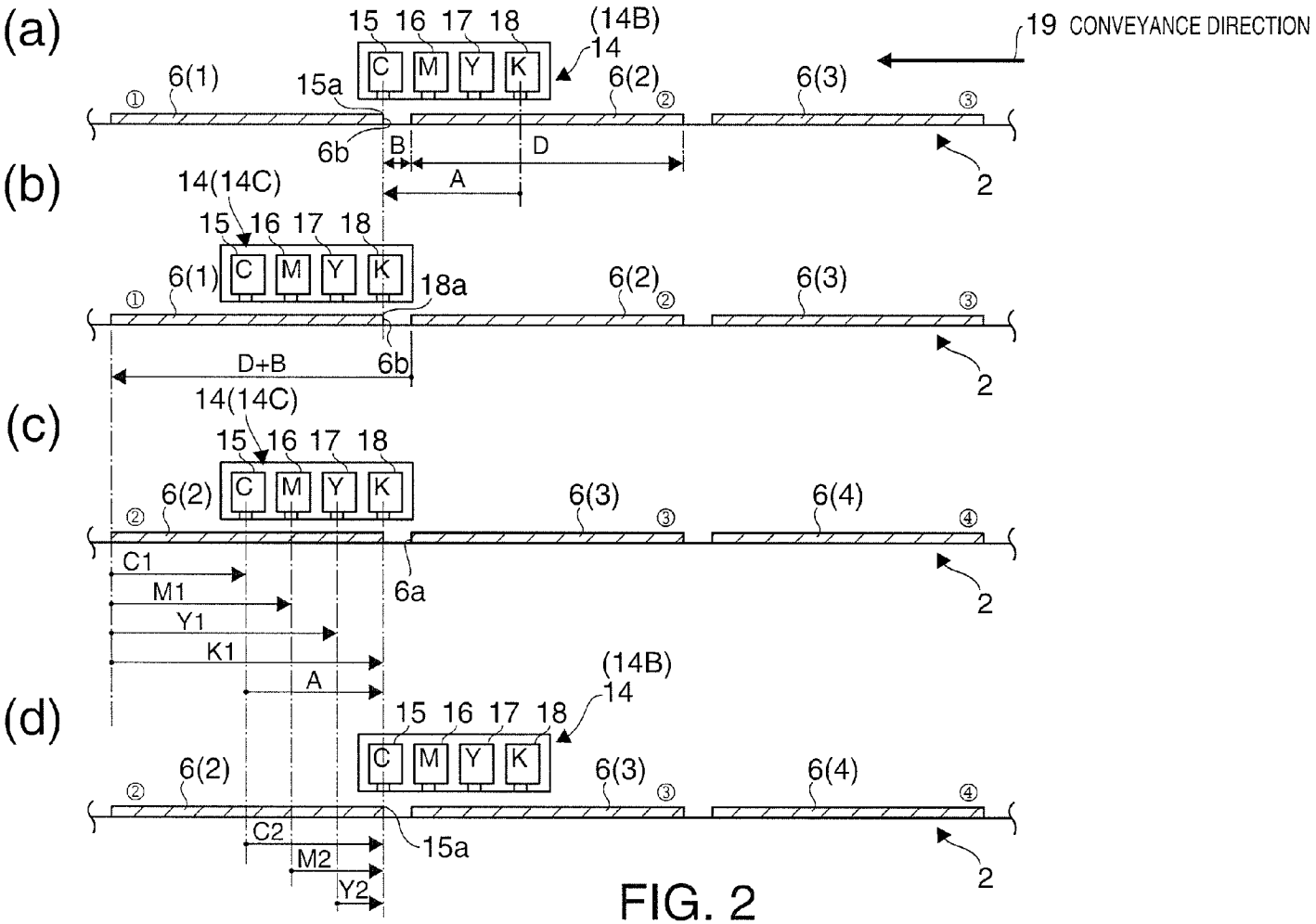
FIG. 2 describes a first embodiment of the paper printing operation of the invention.

FIG. 2 describes the label printing operation of the line printer 1 according to a second embodiment of the invention. When the label paper 2 is set in the conveyance path 11 in this example, the label paper 2 is positioned so that the trailing end 6*b* (end-of-printing position) of the label 6(1) preceding (on the downstream side of in the conveyance direction) the label 6(2) to be printed is set to the printing position 15*a* of the first inkjet line head 15 of the head unit 14 at the first position 14B as shown in FIG. 2 (*a*). Note that in the initial standby position the head unit 14 is set to the maintenance position 14A opposite the maintenance unit 21.

When a print command for the label 6(2) is then received, the control unit 22 moves the head unit 14 from the first position 14B to the second position 14C (printhead moving step). This second position 14C is set so that the printing position 18*a* of the last inkjet line head 18 in the head unit 14 is aligned with the trailing end 6*b* (end-of-printing position) of the label 6(1) on the downstream side of the label 6(2) to be printed. This position is shown in FIG. 2 (*b*).

The control unit 22 then controls printing the label 6(2). First, the label paper 2 is conveyed in the conveyance direction 19 relative to the head unit 14 stopped at the second position 14C while printing the label 6(2). Printing continues until the trailing end 6*b* of the label 6(2), that is, the end-of-printing position of one job on the label 6(2), reaches the printing position 18*a* of the last inkjet line head 18 of the head unit 14, and label paper 2 conveyance stops when this position is reached. More specifically, if the length of a label 6 on the label paper 2 is D, and the gap between labels 6 is B, the label paper 2 is fed forward distance (D+B).

FIG. 2 (*c*) shows this position. At this point, the part of the label 6(2) between the leading end 6*a* and the printing positions 15*a* to 18*a* of the inkjet line heads 15 to 18 indicated by arrows C1, M1, Y1 are printed using the color inks CMY. Printing black ink K is also completed to the entire print area of the label 6(2) as indicated by arrow K1.

Printing the label 6(2) then continues while moving the head unit 14 from the second position 14C to the first position 14B. When the head unit 14 reaches the first position 14B, printing the color inks to the rest of the label 6(2) is also completed as indicated by arrows C2, M2, Y2 in FIG. 2 (*d*). In other words, moving the head unit 14 and the printing operation stop because printing the label 6(2) is finished.

While printing may shift in the transition from (c) to (d) in FIG. 2, there are no print quality problems because printing black ink K was finished at (c) in FIG. 2, black ink K is used to print information that requires high reliability printing, such as barcodes, and information that is not as important is preferably printed in range A in FIG. 2 (*c*) in the print layout. By using the last inkjet line head 18 to eject black ink K, high reliability printing of machine-read information such as barcodes is possible. The last inkjet line head 18 is thus preferably used for high reliability printing of machine-read information, for example. Alternatively, content requiring high reliability printing could be placed in the area that is printed before moving from (c) to (d) in FIG. 2 (in the area between the leading edge of the label and the printing position of the first inkjet line head 15 in FIG. 2 (*c*)).

The head unit 14 then pauses at this end-of-printing position, that is, the first position 14B, and waits for the next print command. If the next print command is received within a specific time, the control unit 22 moves the head unit 14 from the first position 14B shown in FIG. 2 (*d*) forward distance A in the conveyance direction 19 to the second position 14C (printhead moving step) as shown in FIG. 2 (*b*). To print the next label 6(3), the label paper 2 is first conveyed in the conveyance direction 19 while printing, and the head unit 14 is then moved to the back while continuing printing, in the same way as when printing the label 6(2) described above.

Printing each label 6 (printing each job) thus continues by repeating the actions described in FIGS. 2 (*b*), (*c*), and (*d*). Labels can therefore be printed without conveying the label paper 2 in the reverse of the conveyance direction 19. The label paper 2 can therefore be conveyed with good precision without being affected by slack produced by reversing the label paper 2 as occurs in the label printing operation of the related art. In addition, because the head unit 14 can be moved with greater precision than label paper 2 conveyance, labels can be printed with high print quality overall. Note that the paper feed motor is designed to start up in a shorter distance than distance B in this embodiment, but distance B can be adjusted, or the second position 14C to which the head unit 14 moves can be adjusted, according to the startup performance of the motor.

Part of the path of head unit 14 movement is a path for moving the head unit 14 to the maintenance unit 21. There is therefore no need for a head moving mechanism just for printing labels while moving the head unit 14, and the size and production cost of the line printer 1 can be suppressed.

This embodiment of the invention describes printing on label paper 2 as an example of continuous paper, but as described above the invention can also be applied in the same way to line printers that are used for color printing of receipts, coupons, and other content on continuous paper other than label paper, such as continuous plain paper.

Second Embodiment of a Label Printing Operation

When printing on label 6(2) in the first embodiment described above, the label paper 2 is first fed in the conveyance direction 19 (forward) while the head unit 14 remains at the first position 14B. However, printing while first moving the head unit 14 is also possible.

Figure 3:
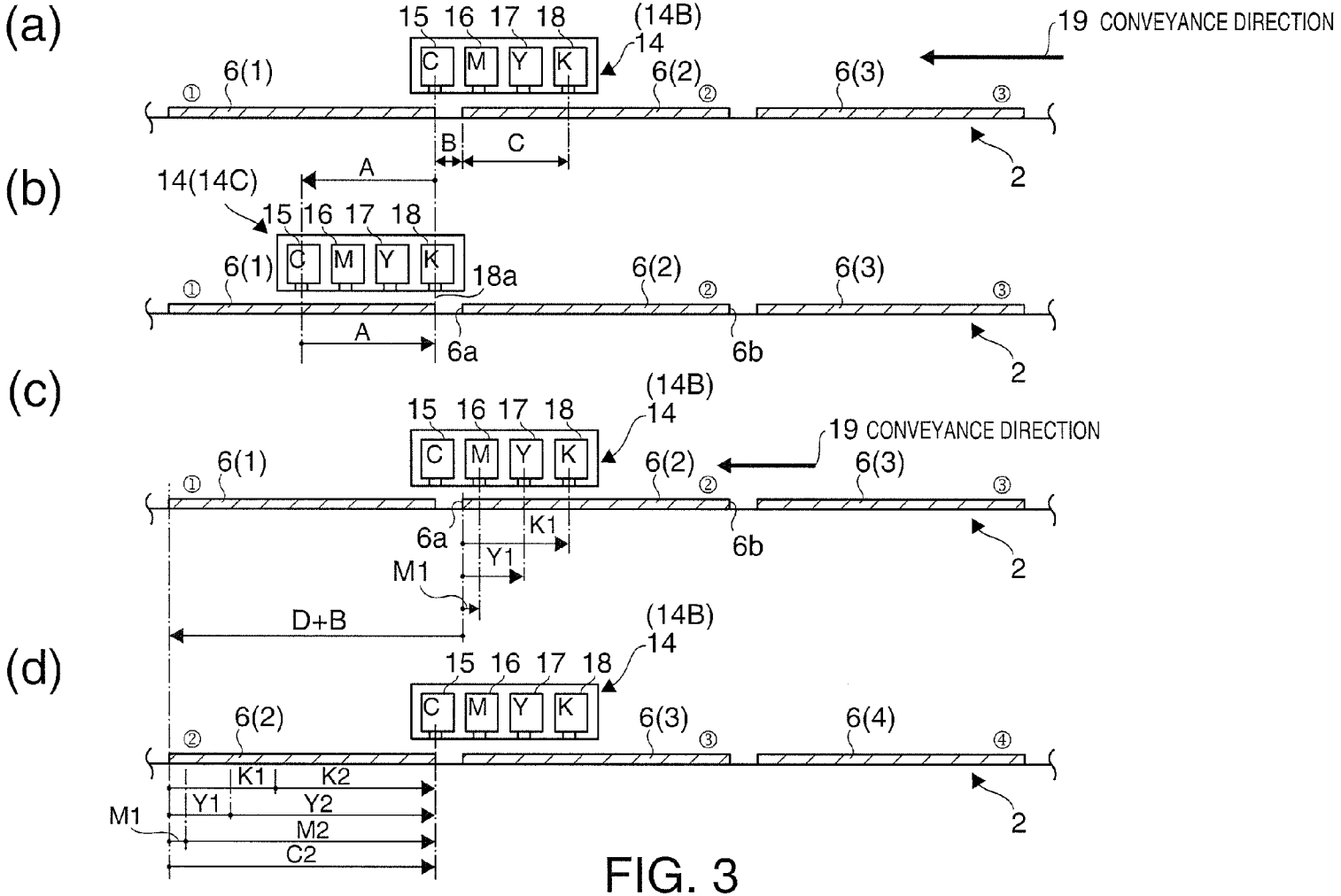
FIG. 3 describes a second embodiment of the paper printing operation of the invention.

FIG. 3 describes this label printing operation.

In this case as shown in FIG. 3 (*a*), the head unit 14 starts at the first position 14B (the end-of-printing position of label 6(1)), and the head unit 14 is then moved distance A in the conveyance direction 19 to the second position 14C as shown in FIG. 3 (*b*).

In the next print step, the label 6(2) is printed while moving the head unit 14 distance A from the second position 14C to the first position 14B. As a result, as shown in FIG. 3 (*c*), black ink K, yellow ink Y, and magenta ink M are printed from the leading end 6*a* to the trailing end 6*b* of the label 6(2) in the areas indicated by arrows K1, Y1, and M1.

The remaining part of the label 6(2) is then printed while moving the label paper 2 in the conveyance direction 19 while the head unit 14 remains stationary at the first position 14B. More specifically, printing continues while the label paper 2 is fed distance (D+B) in the conveyance direction 19. The label 6(2) is then positioned as shown in FIG. 3 (*d*) when printing ends. The head unit 14 then moves from (d) in FIG. 3 to (b) in FIG. 3, and the steps of (b) to (d) in FIG. 3 repeat to print the next label 6(3).

Third Embodiment of a Label Printing Operation

By moving the head unit 14 and also conveying the label paper 2 in the printhead moving step, labels can be printed by moving only the head unit 14 in the label printing step.

Figure 4:
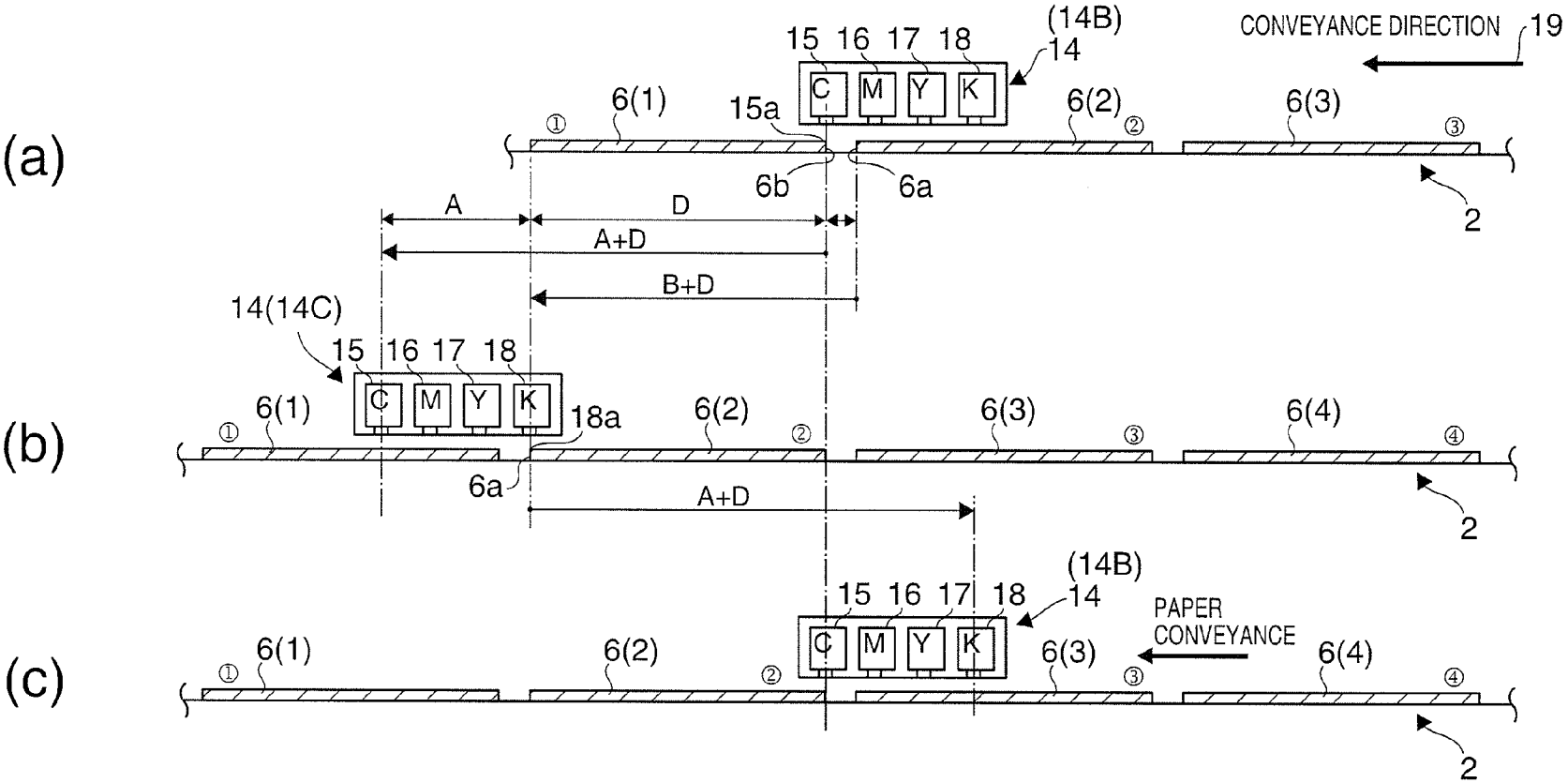
FIG. 4 describes a third embodiment of the paper printing operation of the invention.
Figure 5:
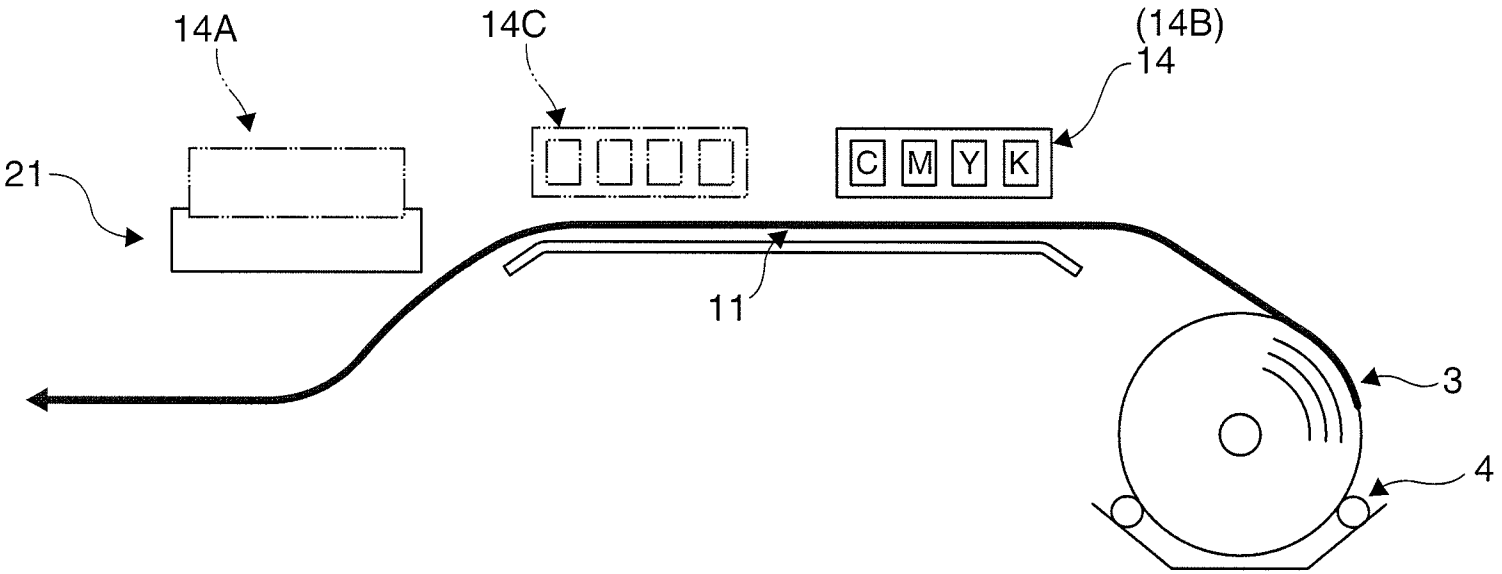
FIG. 5 describes an example of the maintenance position in FIG. 4.
Figure 6:
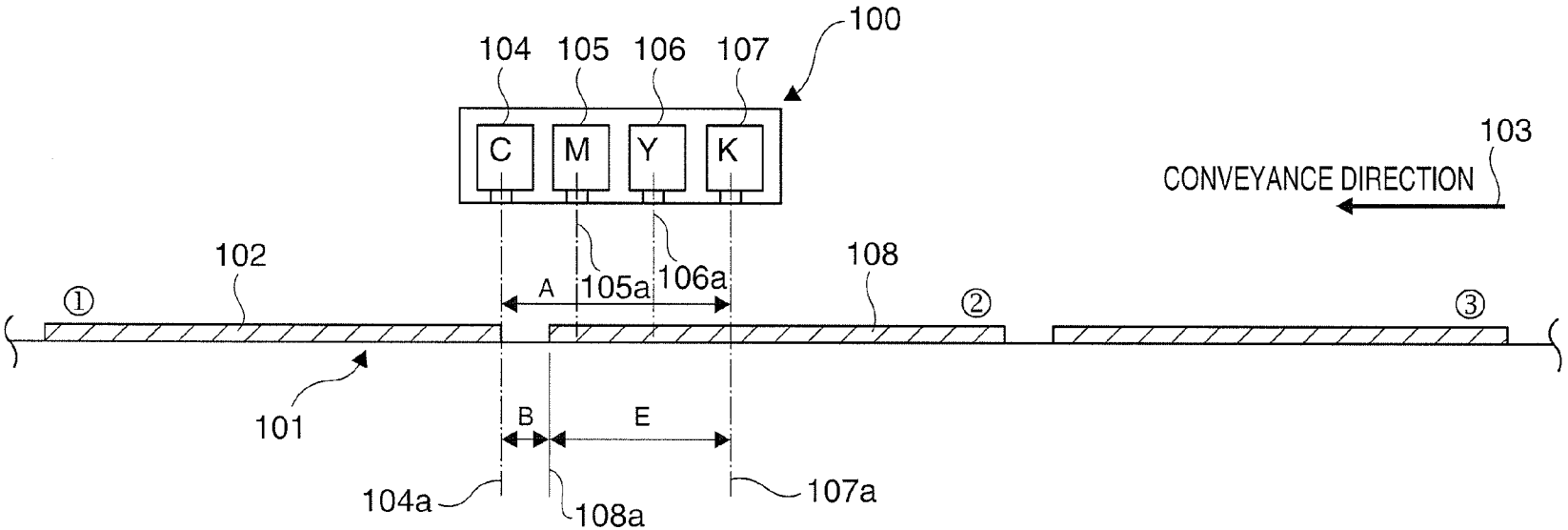
FIG. 6 describes the need for reversing paper in a line printer.

FIG. 4 describes this printing operation. The first time a label is printed or when printing a label ends in this case, the printing position 15*a* of the first inkjet line head 15 in the head unit 14 positioned at the first position 14B is at the trailing end 6*b* (end-of-printing position) of the label 6(1) on the downstream side of the label 6(2) to be printed as shown in FIG. 4 (*a*).

When a command for printing label 6(2) is then received, the control unit 22 performs the printhead moving step. In this step the head unit 14 is advanced distance (A+D) from the first position 14B and set to the second position 14C. At the same time the label paper 2 is conveyed in the conveyance direction 19 so that the leading end 6*a* (the start printing position for one job) of the label 6(2) is at the printing position 18*a* of the last inkjet line head 18 of the head unit 14 at the second position 14C as shown in FIG. 4 (*b*). More specifically, the label paper 2 is conveyed the length (B+D).

In the following printing step, the head unit 14 prints on the label 6(2) while moving in reverse from second position 14C to first position 14B. Because printing the label 6(2) is completed when the head unit 14 returns to the first position 14B, head unit 14 movement and the printing operation end. This position is shown in FIG. 4 (*c*). This position is the same as shown in FIG. 4 (*a*), and the printhead moving step and printing operation are simply repeated as described above to print the next label 6(3).

When printing to labels 6 of the same length, the second position 14C is always the same position in this printing operation. If the length that is printed changes, the second position 14C moves accordingly. This printing method is therefore suited to printing on label paper 2 having labels of the same length affixed thereto.

When the printing operation in this example is used, the maintenance position 14A of the maintenance unit 21 is preferably located to the front (downstream) in the paper feed direction from the second position 14C, that is, the opposite of that shown in FIG. 1. This enables setting the second position 14C, which varies according to the length printed, in the range of the head unit 14 from the maintenance position 14A to the first position 14B, and enables keeping the range of head unit 14 movement constant.

While an inkjet line head is used in the foregoing embodiment of the invention, the invention can obviously also be used with line heads that use other types of printing methods, including color thermal transfer printing using a plurality of thermal line heads.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A paper printing method for a line printer that prints on paper using a head unit having a plurality of line printheads disposed at a specific interval along a conveyance direction of the paper, the method comprising:

a printhead moving step that advances the head unit in the conveyance direction from a predetermined first position on a paper conveyance path to a second position; and performing either a first printing step that prints on the paper while moving the head unit in the reverse of the conveyance direction relative to the paper; or a second printing step that prints on the paper while conveying the paper in the conveyance direction relative to the head unit stopped at the second position, wherein at the second position, the line printhead that is the last of the line printheads of the head unit in the conveyance direction is positioned with respect to the paper (i) at a start printing position of a print job on the paper, or (ii) forward of the start printing position in the conveyance direction.

2. The paper printing method for a line printer according to claim 1, wherein the distance from the first line printhead located at the front of the line printheads in the head unit in the conveyance direction to the last line printhead located at the end in the conveyance direction is distance A;

the printhead moving step repositions the head unit from the first position to the second position located the distance A forward in the conveyance direction; and the printing step prints on the paper while conveying the paper in the conveyance direction relative to the head unit stopped at the second position, stops paper conveyance when the end-of-printing position of a print job on the paper reaches the last line printhead of the head unit, continues printing to the paper while reversing the head unit from the second position to the first position, and stops head unit movement and printing when the head unit reaches the first position.

3. The paper printing method for a line printer according to claim 1, wherein the distance from the first line printhead located at the front of the line printheads in the head unit in the conveyance direction to the last line printhead located at the end in the conveyance direction is distance A;

the printhead moving step positions the head unit the distance A forward in the conveyance direction from the first position to the second position; and the printing step prints on the paper while reversing the head unit from the second position to the first position, stops moving the head unit when the head unit reaches the first position, then continues printing on the paper while moving the paper in the conveyance direction, and stops conveying the paper and printing when the end-of-printing position of one print job on the paper reaches the printing position of the last line printhead of the head unit.

4. The paper printing method for a line printer according to claim 1, wherein the distance from the first line printhead located at the front of the line printheads in the head unit in the conveyance direction to the last line printhead located at the end in the conveyance direction is distance A;

the printing length in the conveyance direction from the start printing position to the end-of-printing position of one print job in the printing step is D;

the printhead moving step positions the head unit to the second position distance A+D forward from the first position in the conveyance direction, conveys the paper in the conveyance direction, and positions the start printing position of one job to the printing position of the last line printhead of the head unit at the second position; and the printing step prints on the paper while moving the head unit from the second position in reverse to the first position, and stops moving the head unit and printing when the head unit returns to the first position.

5. The paper printing method for a line printer according to claim 1, wherein printing is completed in the printing step by the step that prints to the paper while moving the paper in the conveyance direction relative to the stationary head unit.

6. The paper printing method for a line printer according to claim 1, wherein printing is completed in the printing step by the step that prints to the continuous paper while reversing the head unit.

7. The paper printing method for a line printer according to claim 1, wherein:

the line printheads of the head unit are inkjet heads;

the line printer has a maintenance unit for the head unit; and the head unit can move bidirectionally on a movement path from the maintenance unit past the first position to the second position, or a movement path from the maintenance unit past the second position to the first position.

8. The paper printing method for a line printer according to claim 1, wherein the head unit has a plurality of line printheads that eject different colors of ink.

9. The paper printing method for a line printer according to claim 1, wherein the paper is label paper having labels of a specific length affixed at a specific interval along the length of the surface of a liner.

10. A line printer for printing on paper using a head unit having a plurality of line printheads disposed at a specific interval along a conveyance direction of the paper, comprising:

a control unit configured to advance the head unit in the conveyance direction from a predetermined first position on the paper conveyance path to a second position, and control either a first printing operation to print on the paper while moving the head unit in the reverse of the conveyance direction relative to the paper; or a second printing operation to print on the paper while conveying the paper in the conveyance direction relative to the head unit stopped at the second position, wherein at the second position, the line printhead that is the last of the line printheads of the head unit in the conveyance direction is positioned with respect to the paper (i) at a start printing position of a print job on the paper, or (ii) forward of the start printing position in the conveyance direction.

11. The line printer according to claim 10, wherein:

the distance from the first line printhead located at the front of the line printheads in the head unit in the conveyance direction to the last line printhead located at the end in the conveyance direction is distance A; and the control unit is configured to reposition the head unit from the first position to the second position located the distance A forward in the conveyance direction, to print on the paper while conveying the paper in the conveyance direction relative to the head unit stopped at the second position, to stop paper conveyance when the end-of-printing position of one job on the paper reaches the printing position of the last line printhead of the head unit, to continue printing to the paper while reversing the head unit from the second position to the first position, and to stop head unit movement and printing when the head unit reaches the first position.

12. The line printer according to claim 10, wherein the distance from the first line printhead located at the front of the line printheads in the head unit in the conveyance direction to the last line printhead located at the end in the conveyance direction is distance A;

the control unit is configured to position the head unit the distance A forward in the conveyance direction from the first position to the second position, to print on the paper while reversing the head unit from the second position to the first position, to stop moving the head unit when the head unit reaches the first position, then to continue printing on the paper while moving the paper in the conveyance direction, and to stop conveying the paper and printing when the end-of-printing position of a print job on the paper reaches the printing position of the last line printhead of the head unit.

13. The line printer according to claim 10, wherein the distance from the first line printhead located at the front of the line printheads in the head unit in the conveyance direction to the last line printhead located at the end in the conveyance direction is distance A;

the printing length in the conveyance direction from the start printing position to the end-of-printing position of one job in the printing step is D; and the control unit is configured to position the head unit to the second position distance A+D forward from the first position, conveys the paper in the conveyance direction, and to position the start printing position of one job to the printing position of the last line printhead of the head unit at the second position, to print on the paper while moving the head unit from the second position in reverse to the first position, and to stop moving the head unit and printing when the head unit returns to the first position.

14. The line printer according to claim 10, further comprising:

a maintenance unit for the head unit;

wherein the line printheads of the head unit are inkjet heads; and the head unit is movable bidirectionally on a movement path from the maintenance unit past the first position to the second position, or a movement path from the maintenance unit past the second position to the first position.

15. The line printer according to claim 10, wherein the head unit has a plurality of line printheads that eject different colors of ink.

16. The line printer according to claim 10, wherein the paper is label paper having labels of a specific length affixed at a specific interval along the length of the surface of a liner.

* * * * *